United States Patent [19]

Bender et al.

[11] 4,153,542

[45] May 8, 1979

[54] HIGH INTENSITY MAGNETIC SEPARATOR FOR THE WET PREPARATION OF MAGNETIZABLE PARTICLES OF SOLIDS

[75] Inventors: Hans Bender, Leverkusen; Wolf Zabel, Seelscheid; Gottfried Duren; Karl-Heinz Unkelbach, both of Cologne, all of Fed. Rep. of Germany

[73] Assignee: Klöckner-Humboldt-Deutz AG, Fed. Rep. of Germany

[21] Appl. No.: 857,975

[22] Filed: Dec. 6, 1977

[30] Foreign Application Priority Data

Dec. 6, 1976 [DE] Fed. Rep. of Germany ..... 2655139

[51] Int. Cl.[2] ..... B03C 1/14

[52] U.S. Cl. ..... 209/223 R; 210/222; 209/232; 209/11

[58] Field of Search ..... 209/223 R, 214, 232, 209/39, 11; 210/222, 223; 335/216

[56] References Cited

U.S. PATENT DOCUMENTS

| | | | |
|---|---|---|---|
| 1,527,069 | 2/1925 | Peck | 209/214 |
| 3,375,925 | 4/1968 | Carpenter | 209/223 R X |
| 3,503,504 | 3/1970 | Bannister | 209/223 R |
| 3,849,301 | 11/1974 | Reading | 209/214 |

FOREIGN PATENT DOCUMENTS

| | | | |
|---|---|---|---|
| 2157217 | 5/1973 | Fed. Rep. of Germany | 209/223 R |
| 2339255 | 2/1974 | Fed. Rep. of Germany. | |
| 2606408 | 8/1977 | Fed. Rep. of Germany | 210/222 |

*Primary Examiner*—Ralph J. Hill

*Attorney, Agent, or Firm*—Hill, Gross, Simpson, Van Santen, Steadman, Chiara & Simpson

[57] ABSTRACT

A high intensity magnetic field separator for the wet preparation of magnetizable particles of solids receives a charging material having a carrier medium with the particles therein through an arrangement of ferromagnetic bodies, organized as a matrix, in the area of a magnetic field. A hollow body of magnetically inert material is rotatably mounted for rotation about a vertical axis and carries a ferromagnetic body on its outer side and rotates in close proximity about at least one magnetic system which fixedly mounted within the interior of the rotating body. The hollow body is at least approximately rotationally symmetrical and is preferably a cylinder, but may take the shape of a truncated cone or a polygon. The magnetic system comprises an arrangement of superconducting coils in a cryostat which has refrigeration conduits extending down through the open of the hollow body and downwardly through the base of the machine which mounts the hollow body.

3 Claims, 3 Drawing Figures

HIGH INTENSITY MAGNETIC SEPARATOR FOR THE WET PREPARATION OF MAGNETIZABLE PARTICLES OF SOLIDS

BACKGROUND OF THE INVENTION

1. Field of the Invention

This invention relates to a high intensity magnetic field separator for the wet preparation of magnetizable particles, and more particularly to such a separator in which the charging material with a carrier medium is passed through an arrangement of ferromagnetic bodies.

2. Description of the Prior Art

A magnetic separator of the type mentioned above is generally known, for example, from the German published application No. 2,339,255. The magnetic separator, which operates according to the matrix principle, has an annularly shaped housing which is moved through a magnetic field and is equipped with a plurality of grid-shaped ferromagnetic bodies called the matrix. Magnetic poles serve for the production of the magnetic field, the poles surrounding the housing without contact from within and without in the manner of tongs or grippers. These poles are parts of a heavy U-shaped iron yoke which is magnetically energized by means of a coil which has a current flowing therethrough.

The construction of the separator according to the German published application No. 2,339,255 is typical for the category of separators known as hold-back separators, and has a series of disadvantages:

By means of the magnets arranged within and outside of the ring-shaped matrix, there results an undesirable large structural volume, which increases through the necessity of providing an expenditure of material, for stability, of uneconomical dimensions; and As a result of the above, there also results a seriously hampered accessibility of the preparation part, the matrix, whereby supervision, cleaning and maintenance of the magnetic separator become extremely difficult.

The vertical dimensioning of the poles, and therewith the depth of the matrix, is limited in the case of the known pole arrangement, whereby the function of the magnetic separator is subjected to narrow limits with respect to quality and quantity.

The rotary mechanism and holding mechanism of the ring-shaped housing, which because of the magnetic arrangement must be disposed above the poles, is relatively expensive, and therefore subject to disturbance and is additionally, locationwise, in a poor and undesirable position.

SUMMARY OF THE INVENTION

The object of the present invention is to provide a high intensity magnetic field separator which overcomes the above disadvantages and which economically achieves both qualitative and quantitative improvement of such magnetic separators which have a matrix.

The above object is achieved by providing a hollow body of magnetically inert material which is mounted for rotation about a vertical axis and which carries a ferromagnetic body on its outer side and rotates in close spacing about at least one magnetic system which is stationary within the interior of the hollow body.

In a particular embodiment of the invention, the form of the hollow body is approximately rotationally symmetrical and is preferably constructed as a cylinder, although it may be in the form of a truncated cone or a polygon. Furthermore, a magnetic separator according to the present invention has the advantage of an open magnetic system.

An optimum of functional advantages is attained in that the magnetic system comprises an arrangement of superconducting coils.

In another particular embodiment of the apparatus, according to the invention, the hollow body is in the form of a bell having its lower open rim rotatably positioned on a machine base, the bell receiving a cryostat in its interior with superconducting coils, the supervision or maintenance conduits of the cryostat extend downwardly through the machine base.

In another embodiment of the invention, the rotary drive of the hollow body is arranged in its inner chamber.

BRIEF DESCRIPTION OF THE DRAWINGS

Other objects, features and advantages of the invention, its organization, construction and operation will be best understood from the following detailed description, taken in conjunction with the accompanying drawings, on which.

DESCRIPTION OF THE PREFERRED EMBODIMENTS

Figure 1:
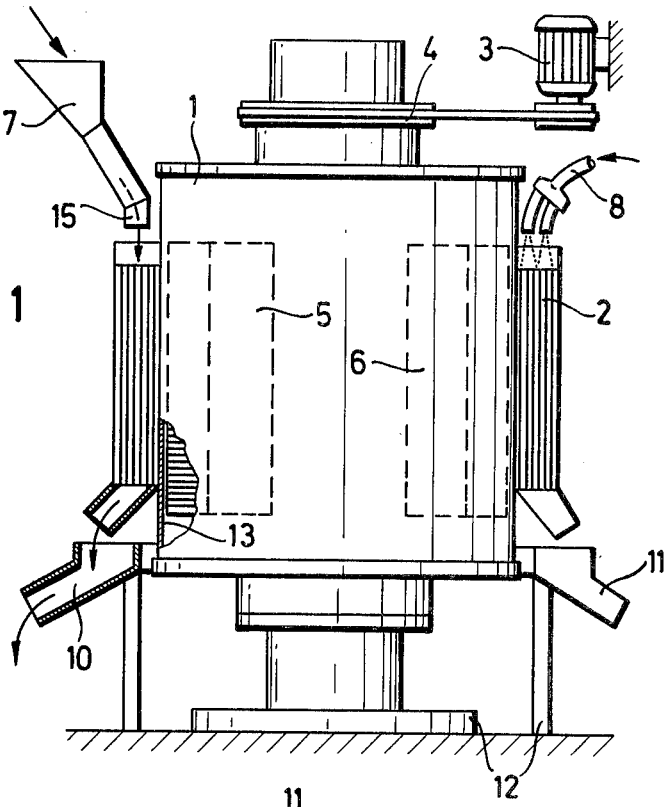
FIG. 1 is an elevational view of a magnetic separator, shown partially in section.

FIG. 1 illustrates a magnetic separator which comprises a hollow body 1 and a plurality of matrices 2 which are fixed to the outer sleeve of the body 1. The hollow body 1, by means of a bearing which is not illustrated, is rotatably mounted for rotation about a vertical axis and is rotated by a rotary drive which is schematically illustrated as comprising a driving motor 3 and a belt drive 4.

A pair of magnetic systems 5 and 6 are fixedly mounted within the hollow body 1. A feed 7 is provided for charging the separator with a carrier medium containing the magnetizable particles. A washing station 8 is provided for washing out the magnetic concentrate, the collection gutter 10 for the waste and the collection gutter 11 for the concentrate. The entire apparatus is supported by a machine frame 12.

Figure 2:
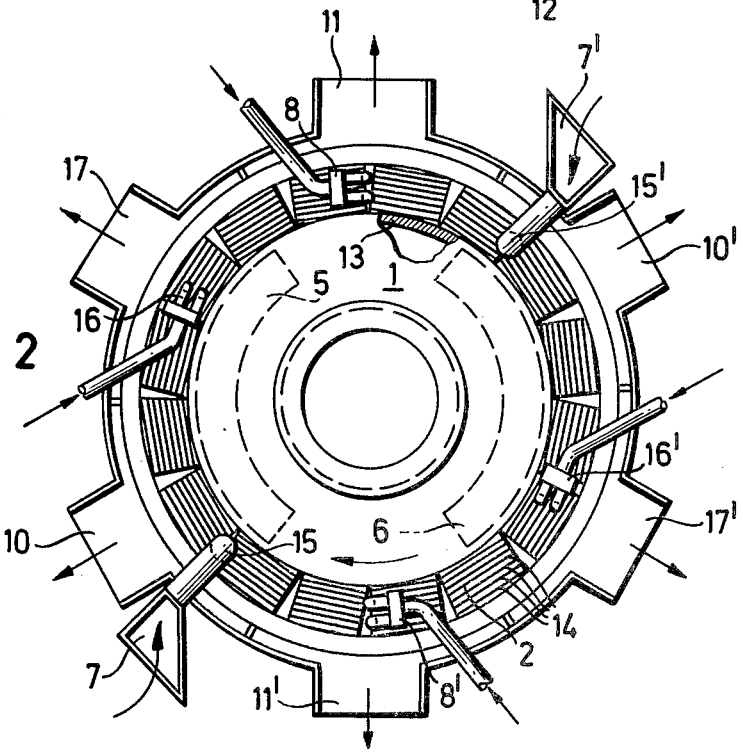
FIG. 2 is a top plan view of the magnetic separator illustrated in FIG. 1.

FIG. 2 illustrates a top plan view of the magnetic separator of FIG. 1. In FIG. 2 it can be seen that the hollow body 1 includes an outer wall 13 on which the matrices 2 are fixed. Each matrix comprises, for example, boxes having fluted plates 14 fixed spaced from one another. Furthermore, within the interior of the hollow body 1 is a pair of magnetic systems 5 and 6 which, for example, although not illustrated in detail, are constructed of superconducting coils which are arranged in a cryostat.

The magnetic separator of FIGS. 1 and 2 operates as follows.

The hollow body 1 rotates in the direction of the arrows provided on FIG. 2, together with the matrices 2 which are closely spaced to the magnetic systems 5 and 6 fixed within the interior of the body 1. A pair of feed stations 7 and 7' are located at the inlet areas of the matrices 2, respectively, in respective ones of the magnetic fields, and have respective outlet nozzles 15, 15' through which a slurry is conveyed from above while the matrices 2 are moved thereunder, whereby the magnetizable particles are fed into the boxes and are held fast on the fluted profile of the plates 14, while the magnetically inert waste particles float downwardly with the remainder of the sludge and are collected by gutters 10 and 10'. The plan view of FIG. 2 also illustrates a pair of washing stations 16 and 16' within the magnetic fields at positions which are arcuately spaced, in the direction of rotation, from the respective feed stations 7 and 7'. The washing stations 16 and 16' wash out the matrices 2 with wash water of a moderate pressure, whereby the concentrate is freed from adherent non-magnetic material, and if need be, in each case according to intensity of the washing, from middlings. The waste is collected by a respective collection gutter 17, 7'.

Outside of the magnetic fields, the matrices 2 pass through the washing stations 8 and 8' which wash the magnetic concentrate from the matrices 2 with a powerful jet of washing water, the concentrate being collected in respective gutters 11 and 11'. Subsequently, the cleansed matrices are available to again separate magnetizable particles from the slurry as they reenter the magnetic fields produced by the magnetic systems 5 and 6.

Figure 3:
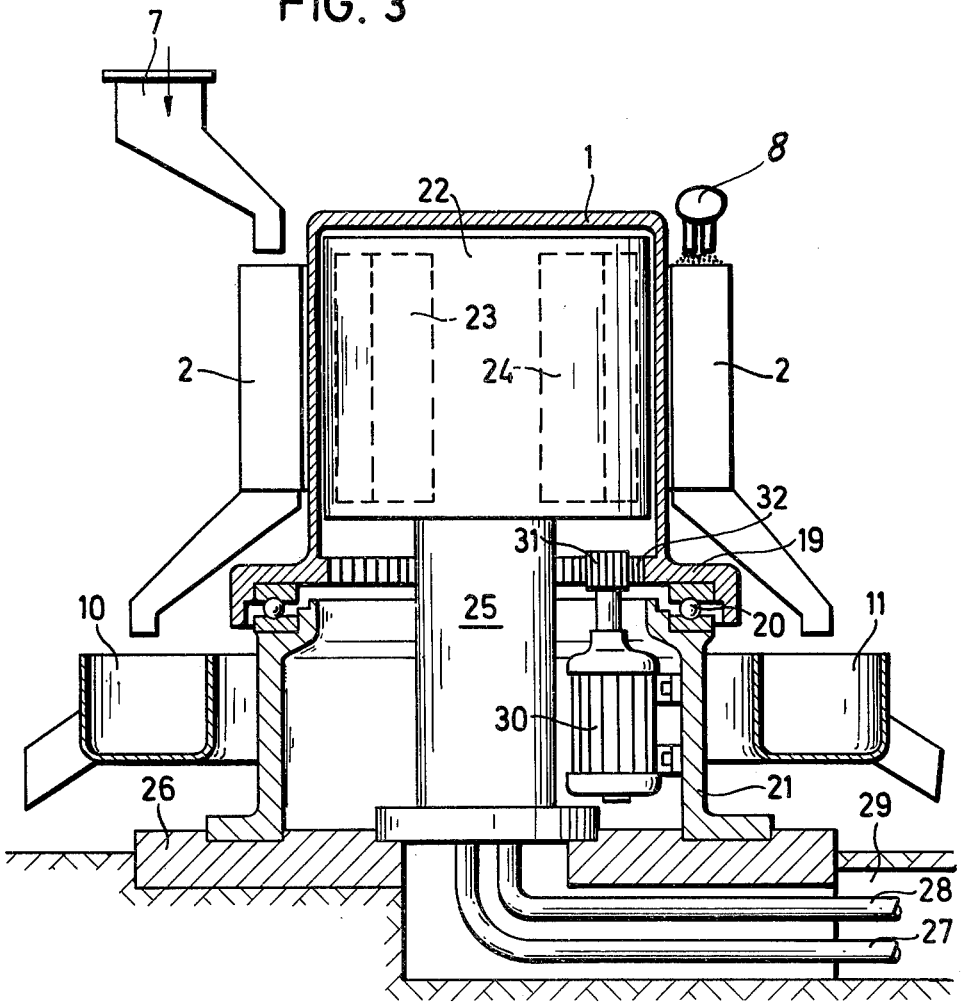
FIG. 3 is an elevational view of another magnetic separator, also shown partially in section, and specifically illustrating an embodiment of the invention in which the hollow body is in the form of a bell which is rotatably mounted on a machine base and which receives a cryostat therein having conduits which extend downwardly through the machine base, and wherein the rotary drive for the bell is arranged within the inner chamber of the bell.

Another suitable arrangement of a magnetic separator constructed in accordance with the present invention is illustrated in FIG. 3. In FIG. 3 the hollow body 1 has the shape of a bell which is open at the bottom and which comprises a lower rim 19 which is rotatably positioned on a machine base 21 by way of a ball bearing 20. The hollow body 1 rotates in close spacing about a cryostat 22 which is supported by a support 25, likewise fixedly anchored in the undercarriage or supporting frame 26 of the machine base 21. The conduits 27 and 28 of the cryostat, for example insulated feeds for liquid helium, are guided downwardly through the hollow interior of the stand 25 and distributed in a maintenance channel 29. A particularly suitable embodiment of the rotary drive is constructed as illustrated in FIG. 3 in which a motor 30 is mounted within the base 21 and is provided with a pinion 31 which engages an inner rim gear 32 which is disposed within the inner chamber or space of the hollow body 1.

In this manner a particularly compact and closed type of construction is provided and optimum operation is attained with a minimum of structural expenditure.

In addition, the main functioning elements, such as the cryostat and rotary drive are encapsulated, that is they are hermatically sealed with respect to the outside and therefore best protected for injurious operational influences. Particularly impressive, in this connection, is the facility of inspection and accessibility of the matrices 2 with the pertaining charging station 7, washing station 8, collection gutters 10 and 11, and the like.

The present invention is not limited solely to the examples and arrangements shown. Rather, a series of further modifications is possible. For example, the hollow body, instead of having the shape of a cylinder, may have the form of a truncated cone or a polygon, or the matrices may be formed of ring-shaped containers having loose ferromagnetic bodies arranged therein, or the number of magnetic poles may be varied.

Alternatively, for example, also several rows or series of matrix arrangements may be arranged reciprocally on the hollow body sleeve.

Such alternatives and similar alternative embodiments of the invention serve only for the selection of an optimal form of construction and for a predetermined purpose of preparation, whereby the latter is determined by one skilled in the art by means of systematic tests and routine construction. We therefore intend to include within the patent warranted hereon all such changes and modifications as may reasonably and properly be included within the scope of our contribution to the art.

We claim:

1. A high-intensity magnetic field separator for magnetizable particles in a carrier medium forming a slurry, comprising:

a hollow non-magnetic body mounted for rotation about a vertical axis and including an outer wall;

means for rotating said body;

a matrix of ferromagnetic material mounted on the outer surface of said outer wall;

feed means for feeding the slurry through said matrix;

a magnetic system fixedly mounted within said hollow body close to said outer wall to be stationary with respect thereto, said magnetic system being constructed as an open magnetic system and being curved complemental to the curvature defined by the rotating outer wall and operable to establish a high-intensity magnetic field which closes upon itself through said outer wall and through the path of rotation of said matrix;

said matrix, when in the magnetic field, attracting the magnetizable particles and permitting the waste to flow through; and means for removing the attracted particles from said matrix.

2. The separator of claim 1, wherein:

said hollow body is constructed in the shape of a bell having an open bottom defined by a peripheral rim;

and comprising a hollow machine base including an annular rim;

a bearing on said annular rim supporting and rotatably mounting said peripheral rim;

said means for rotating said body disposed within said hollow machine base and connected in driving engagement with said peripheral rim, said magnetic system comprising a cryostat including superconducting coils and refrigerant conduits which extend downwardly and out through said machine base.

3. A high intensity magnetic field separator for separating magnetizable particles from a slurry which also contains middlings, waste and a carrier medium, comprising:

drive means;

a hollow non-magnetic body, including an outer wall, mounted for rotation about a vertical axis, said body connected to and rotated by said drive means;

a cryostat stationarily mounted within said hollow body, said cryostat including spaced superconducting coils operable to establish a high intensity magnetic field which extends through said outer wall and over an arcuate section of said outer wall as the same rotates;

at least one matrix of spaced ferromagnetic plates mounted on the outer surface of said outer wall to rotate through the magnetic field;

feed means for feeding the slurry to said matrix as it rotates into the magnetic field, the magnetizable particles thereby attracted to and carried by said plates;

a first wash station operable to spray a wash liquid on said plates while the same are still in the magnetic field to release adherent non-magnetic particles and middlings;

a second wash station outside of the magnetic field operable to spray the plates with a powerful jet of wash liquid to remove the magnetizable particles; and means for separately collecting the waste, middlings and concentrated magnetizable particles.

* * * * *